United States Patent [19]

Ptasinski et al.

[11] 4,167,053

[45] Sep. 11, 1979

[54] FABRIC-COVERED BUTTON AND THE METHOD FOR FABRICATING SAME

[75] Inventors: Leo D. Ptasinski, Chicago; Bruce A. Ferguson, Hinsdale, both of Ill.

[73] Assignee: The Maxant Corporation, Chicago, Ill.

[21] Appl. No.: 900,756

[22] Filed: Apr. 27, 1978

[51] Int. Cl.[2] ..... A44B 1/12

[52] U.S. Cl. ..... 24/113 R; 24/90 C; 24/245 R; 79/1; 24/256

[58] Field of Search ..... 24/113 R, 92, 90 C, 24/163 FC, 256

[56] References Cited

U.S. PATENT DOCUMENTS

| | | | |
|---|---|---|---|
| 1,399,730 | 12/1921 | Abe | 24/90 C |
| 2,701,400 | 2/1955 | Sonderby | 24/113 R |

*Primary Examiner*—Bernard A. Gelak

*Attorney, Agent, or Firm*—Jakala, Knechtel, Valentino, Demeur & Dallas

[57] ABSTRACT

A fabric covered button comprising a button head having a peripheral groove for receiving a locking ring. The fabric is secured to the button head and the marginal edge thereof is retained within the groove by the locking ring.

24 Claims, 8 Drawing Figures

FABRIC-COVERED BUTTON AND THE METHOD FOR FABRICATING SAME

This invention relates to improvements in fabric-covered buttons and to the method and apparatus for fabricating them.

Buttons of the type with which the invention is concerned, i.e., fabric-covered buttons, are well known and have been used for many years. Such buttons have been and are used in a variety of different applications, two of the principal ones of which are probably dress making and upholstering. The buttons are generally covered with a fabric or other material which matches the particular garment or article such as an upholstered chair or sofa. Buttons of this type are disclosed in at least the following U.S. patents, namely, U.S. Pat. Nos. 174,161; 202,907; 1,164,460; 2,649,634; 2,716,794; 3,425,101; and 3,934,314.

The existing fabric-covered buttons all generally comprise a stamped metal shell which is formed to receive in the back side thereof a stamped metal disc. In assembling the buttons, the fabric is draped or wrapped over and around the sides of the shell, and then the disc is forcibly or otherwise urged into the back side of the shell so as to captivate the fabric between the interior periphery of the shell and the outer periphery of the disc. The disc is sometimes provided with prongs or the like to more securely retain the fabric about the shell and to secure the disc and the shell together as an assembly.

While these fabric-covered buttons have been used for many years, and have been substantially improved upon over the years, most of them are objectionable for one reason or another, and all of them are objectionable in that in too many cases, the disc becomes separated from the shell, thus permitting the fabric to become separated from the button. In many cases, the disc, as well as functioning to complete the assembly of the button and to contain the fabric about the shell, also is formed or provided with securement means for fastening the buttons to a garment or an article. In such cases, the various forces and stresses exerted upon the button pull or otherwise disengage the disc from the shell so that only the disc remains attached, while the shell and the fabric covering are lost. This deleterious result has, to some extent, been overcome by, in some constructions, affixing the securement means to the shell and then adapting the disc to receive therethrough the securement means so that the latter then can be used to affix the button to a garment or article. However, such constructions do not fully overcome the problem, for the fabric still is secured about the shell by means of the disc and the disc still, in too many cases, becomes dislodged so that the fabric becomes loose or lost.

In most cases, the shells and the discs are stamped from a thin metal and the securement means are wire loops or the like secured in some fashion, e.g., by welding, to either the disc or the shell. In those constructions where the wire securement means is affixed to the shell, the front exposed face of the shell, once the fabric is lost, usually is marred or otherwise disfigured so that the bare shell is generally unsightly to an observer and ruins the appearance of the garment or article.

While, as indicated above, substantial improvements have been made to the construction of these fabric-covered buttons, in an attempt to overcome various objectionable features associated with it, each improvement generally has increased the cost of material or manufacture and assembly, or both.

A factor which must be taken into consideration in the design of any new button of this type is the face that most garment, upholstery and other manufactures who utilize these buttons do not make them, but purchase them from button manufacturers. In addition, these users many times do not assemble these buttons, i.e., place the fabric on them, but instead, simply supply the fabric and have the assembly done by others. The larger users may assemble the buttons themselves. In any case, the buttons are generally assembled using dies or tools specifically designed for this purpose, thus the adaption of any new button construction normally likewise requires the purchase of new dies or tools.

Another factor which also must be taken into consideration is that the components or button parts from which the fabric-covered buttons are formed, are sold, usually in kits, to housewives, amateur dressmakers and the like who form or assemble their own fabric-covered buttons. The components or button parts therefore should be of a construction which permits the utilization thereof in such kits.

The fabric-covered button of the present invention or, more particularly, the components or button parts which are used in forming or assembling a fabric-covered button, is of a two-piece construction and includes a button head which advantageously can have any one of a number of different types of securement means integrally or otherwise formed with it, and a locking ring. The button head has a locking groove formed in the side edge or wall thereof, about its periphery, which groove is sized and proportioned to receive therein the marginal edge of the fabric covering the button head and to securely retain the fabric and the locking ring to the button.

More particularly, the function of the locking ring can be better understood by first describing the assembled button, i.e., the button covered with a fabric. The fabric covers the head of the button head and the locking ring, and the marginal edge of the fabric is captivated and retained in and between the locking groove in the side edge or wall of the button head and the locking ring, so that both the button head and the locking ring are covered with and concealed by the fabric. Accordingly, in accordance with a preferred embodiment of the invention, during assembly, the locking ring with the fabric disposed between its interior diameter and the button head must expand sufficiently to permit it to be forcefully urged over the button head into the locking groove in the side edge or wall of the button head, and must have sufficient "elastic memory" to then contract and effectively squeeze the fabric into the locking groove. The locking ring may or may not contract to the extent that a substantial portion of its cross-sectional area or diameter is disposed within the locking groove, depending upon the thickness of the fabric used to cover the button. In this respect, the proportional relationship between the diameter of the locking ring, the cross-sectional area or diameter of the locking ring, the diameter of the button head and the depth of the locking groove is critical only to the extent that some portion of the cross-sectional area or diameter of the locking ring is contracted or compressed to extend within the locking groove, so long as the fabric is tightly pressed into the locking groove by the locking ring. In various experiments, it was found that a satisfactory fabric-covered button could be assembled so long as at least some small portion of the cross-sectional area or diameter of the locking ring extended into the locking groove, and the fabric is tightly pressed into the locking groove.

In order to achieve this relationship, a number of different adjustments can be made. For example, if a very thin fabric is used to cover the button, two or more layers of the fabric can be used. Alternatively, a smaller diameter locking ring can be used. Conversely, if a thick fabric is used, a larger diameter locking ring can be used, or the depth of the locking groove in the side edge or wall of the button head can be increased.

Also, during the assembly of the button, the fabric may simply extend around the locking ring and only partially fill the locking groove. The fabric may also fill the locking groove and extend therefrom so as to overlap the outer peripheral top edge of the button head. This overlapped portion of the fabric is sandwiched between the button head and the fabric covering it.

The button head, and particularly, the locking groove in the side edge or wall thereof, may be textured to provide a slightly roughened surface which functions to or adds to the gripping action exerted upon the fabric by both the button head and the locking ring, to prevent the fabric from becoming disassociated from or slipping on the button head. In addition, an adhesive or the like may be applied to the button head for this purpose.

The button head preferably and advantageously is molded of plastic, although other materials can be used. The button heads can be molded in different colors so that the button heads can be selected to coordinate with the color of the fabric. By doing so, in the event that the garment and/or the fabric-covered buttons are subjected to abuse or unusual wear which results in the inadvertent loss of the fabric covering, the button head will blend in with the fabric and will not stand out in contrast with the fabric, as in the case of existing stamped metal button shells and/or the stamped metal discs. The texturing on the button head also can be formed thereon to add to decorative finish, as well to color, to the exposed button head. The button head is also advantageously formed in a fashion such that its diameter can be compressed, i.e., reduced, to a small degree, during the assembly operation. This may be accomplished, for example, by forming cross or concentric grooves or the like, in the top surface of the button head, so that the peripheral forces exerted on the button, as when the locking ring is engaged with it, will cause it to slightly compress. This will relieve some of the stress exerted on the locking ring, during assembly of the button, so that the locking ring is less likely to be damaged during assembly and its elastic memory is not exceeded such that a tight gripping or locking action is provided by the locking ring.

As indicated above, the locking ring may be of any suitable material having the necessary elastic memory which will permit it to be forcibly urged, together with the fabric, into locking engagement in the locking groove in the button head. One such suitable material is LEXAN, but other materials having this elastic memory also can be used.

The fabric-covered button of the present invention can be easily assembled with a two-part die or tool. During assembly, the locking ring and the fabric covering are inserted in one part thereof, and the button head is inserted in the other part thereof. The die or tool parts are longitudinally aligned and are moved longitudinally with respect to one another. The operation and construction of the die or tool parts is such that the fabric is "rolled" about the outer peripheral diameter of the locking ring, into the interior thereof, and then the locking ring with the fabric disposed about it is forcibly urged over the button head into its locking groove, thereby securing the fabric to the button head.

Accordingly, it is an object of the present invention to provide improvements in fabric-covered buttons and, more particularly, improvements to and in the method and apparatus for fabricating them.

The invention and the preferred features thereof outlined above, will now be described in greater detail with reference to the accompanying drawings, in which.

DESCRIPTION OF PREFERRED EMBODIMENT

Figure 1:
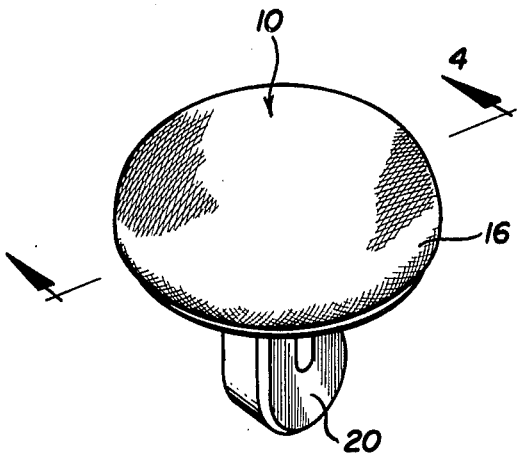
FIG. 1 is a perspective view of a fabric-covered button exemplary of the invention.

Referring now to the drawings, in FIG. 1 there is illustrated a fabric-covered button 10 which, in accordance with the invention, includes components or button parts which are used in forming or assembling it. As can be best seen in FIG. 2, these components or button parts include a button head 12 which advantageously can have any one of a number of different types of securement means 20 integrally or otherwise formed with it, and a locking ring 14 which, in accordance with a preferred embodiment of the invention, is of a material which has an "elastic memory," i.e., the ability to expand and to return to its original or substantially to its original dimension. The button head has a locking groove 18 formed in the side edge or wall thereof, about its periphery, which locking groove 18 is sized and proportioned to receive therein the marginal edge of the fabric 16 covering the button head 12 and to securely retain the fabric and the locking ring to the button head 12, as generally illustrated in FIG. 4.

Figure 4:
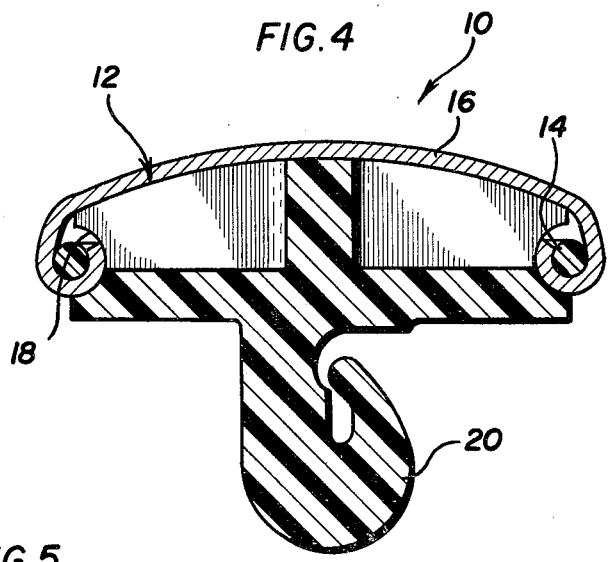
FIG. 4 is a sectional view taken substantially along lines 4—4 of FIG. 1.

More particularly, as can be best seen in FIG. 4, the fabric 16 covers the head of the button head 12 and the locking ring 14, and the marginal edge of the fabric 16 is captivated and retained in and between the locking groove 18 in the side edge or wall of the button head 12, and the locking ring 14, so that both the button head 12 and the locking ring 14 are covered with and concealed by the fabric. Accordingly, as indicated above, during assembly, the locking ring 14 with the fabric 16 disposed between its interior diameter and the head of the button head 12 must expand sufficiently to permit it to be forcibly urged over the head of the button head 12 in the locking groove 18, and must have sufficient "elastic memory" to then contract and effectively squeeze the fabric 16 into the locking groove 18.

Accordingly, the locking ring 14 must be of a suitable material having the necessary elastic memory which will permit it to be forcibly urged, together with the fabric 16, into locking engagement in the locking groove 18 in the button head 12. One such suitable material is LEXAN, but other materials having this elastic memory also can be used.

Figure 3:
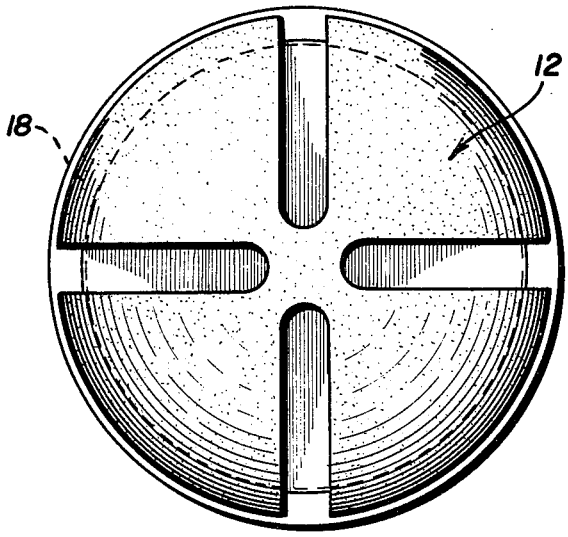
FIG. 3 is a top plan view of the button head of the fabric-covered button.

The proportional relationship between the diameter of the locking ring 14, the cross-sectional area or diameter of the locking ring 14, the diameter of the button head 12 and the depth of the locking groove 18 is critical only to the extent that some portion of the cross-sectional area or diameter of the locking ring 14 is contracted or compressed to extend within the locking groove 18, so long as the fabric is tightly pressed into the locking groove 18 by the locking ring 14, as generally illustrated in FIG. 4. A satisfactory fabric-covered button 10 can be assembled, so long as at least some small portion of the cross-sectional area or diameter of the locking ring 14 extends into the locking groove 18 and so long as the marginal edge of the fabric 16 is tightly pressed into the locking groove 18. In other words, in various different applications, the locking ring 14 may be contracted or compressed to extend within the locking groove 18 to a greater or lesser degree. Generally, it has been found that the interior diameter of the locking ring 14 should be at least 0.337 inches larger in diameter than the diameter d (FIG. 3) of the locking groove 18 in the button head 12 for use in conjunction with most fabrics. However, the interior diameter of the locking ring 14 can vary within a range of 0.317 to 0.357 inches greater than the diameter d of the locking groove 18, to compensate for the thickness of the fabric 16 used in covering the fabric-covered button 10. Depending upon the type of fabric used, a number of different adjustments can be made in order to achieve the above-defined relationship between the locking ring 14 and the locking groove 18 in the button head 12. For exampl,e if a very thin fabric is used to cover the button, it is also possible to use two or more layers of the fabric to assure that the fabric is tightly pressed into the locking groove 18 by the locking ring 14. Alternatively, a locking ring 14 having a smaller diameter, e.g., one which is only 0.317 inches larger than the diameter d of the locking groove 18 can be used. Conversely, if a thick fabric is used, a larger diameter locking ring 14, e.g., one having a diameter 0.357 larger than the diameter d of the annular groove 18 can be used.

Also, the marginal edge of the fabric 16 may simply extend around the locking ring 14 and only partially fill the locking groove 18, as illustrated in FIG. 4. The marginal edge of the fabric 16 also may extend about the locking ring 14, in the locking ring groove 18, in a fashion such that it overlaps the outer peripheral top edge of the button head 12, with this overlapped portion of the marginal edge of the fabric 16 being sandwiched between the top of the button head 12 and the fabric 16 covering it.

Figure 2:
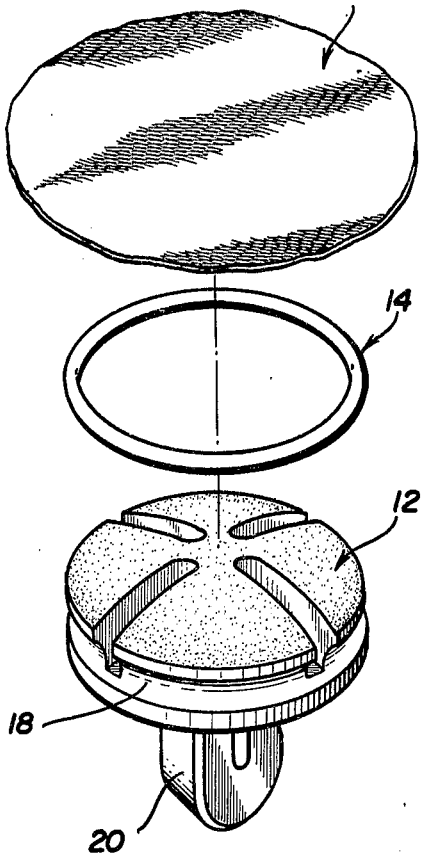
FIG. 2 is an exploded perspective view of a fabric-covered button in accordance with the invention.

As indicated above, the surface of the button head 12 and particularly the surface of the locking groove 18 in the button head 12 may be textured, as generally illustrated in FIG. 2, to provide a slightly roughened surface which functions to or adds to the gripping action exerted upon the fabric by both the button head 12 and the locking ring 14, to prevent the fabric from becoming disassociated from or slipping on the button head 12. In addition, an adhesive may be applied to the button head 12 for this purpose. Also, as indicated above, the button head 12 preferably and advantageously is molded of plastic, in different colors, to compliment or coordinate with the color of the fabric with which the fabric-covered button is used. When the button head 12 is coordinated with the fabric, if for any reason the fabric 16 should become disassociated with the button head 12, the latter will blend in with rather than contrast with the fabric. The texturing on the button head 12 also can be formed thereon to add a decorative finish, as well as color, to the exposed button head 12.

The button head 12 also is advantageouly formed in a fashion such that its diameter can be compressed, i.e., reduced, to a small degree, during the assembly operation. This may be accomplished, for example, by forming radially extending grooves 22 in the top surface thereof, so that the peripheral forces exerted on the button head 12, as when the locking ring 14 is engaged with it, will cause it to slightly compress. This will relieve some of the stress exerted on the locking ring 14, during the assembly of the button, so that the locking ring 14 is less likely to be damaged during assembly and its elastic memory is not exceeded such that a tight gripping or locking action is provided by the locking ring 14.

Figure 6:
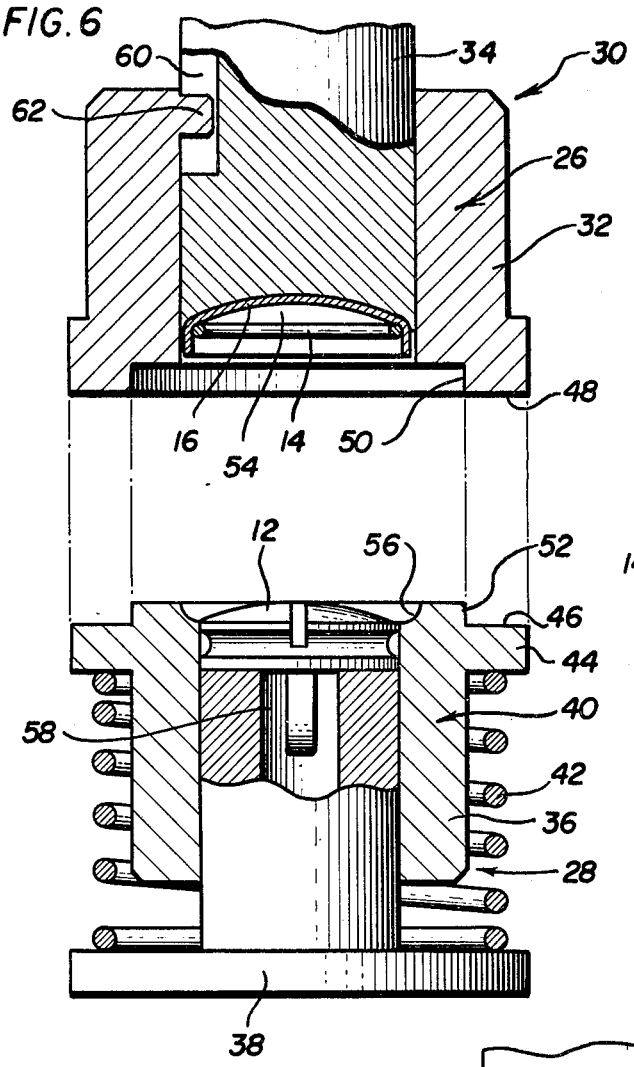
FIGS. 6–8 are sectional views illustrating the die or tool used to assemble the fabric-covered buttons and the manner in which the die or tool is operated or functions to assemble a fabric-covered button.
Figure 7:
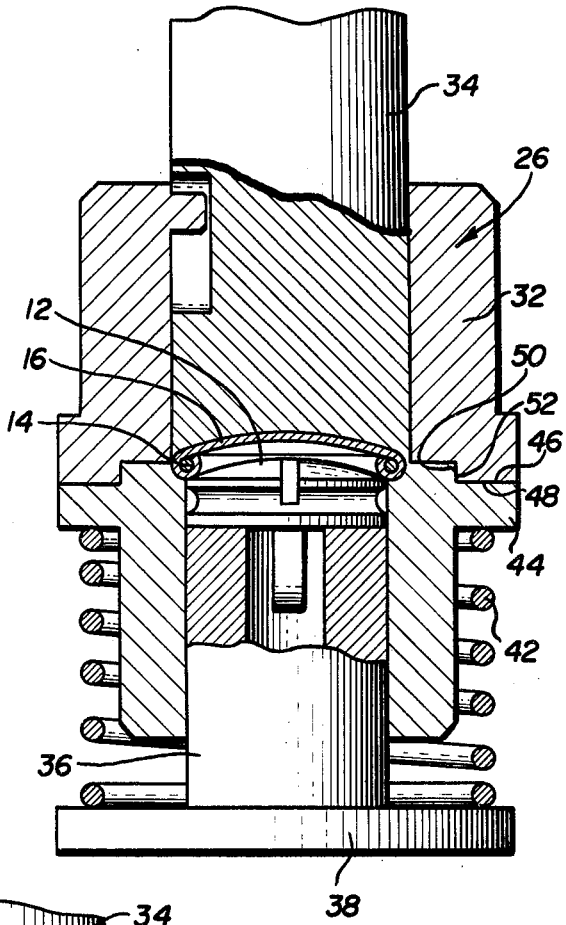
Figure 8:
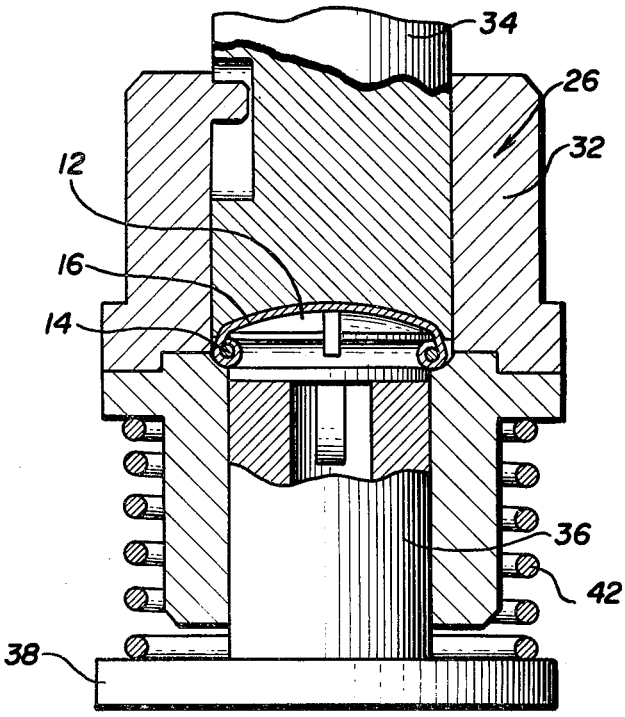

Referring now to FIGS. 6–8, the two-part die or tool 30 which can be used for assembling the fabric-covered button 10, and the manner in which the die or tool 30 operates to assemble the fabric-covered button 10, is illustrated. The die or tool 30 is a two-part die including the die parts 26 and 28. As can be seen, the upper die part 26 includes an upper die housing 32 which has a plunger 34 slidably and reciprocally retained therein. A guide slot 60 is formed in the plunger 34, and the set screw 62 extending through a bore in the upper die housing 32 into the guide slot 60 retains the plunger 34 in operative relationship with the upper die housing 32.

The lower die part 28 includes a die shaft 36 having an enlarged diameter base 38. A die collar 40 is slidably and reciprocally disposed about the die shaft 36. A spring 42 is disposed about the die collar 40, with one end thereof being abutted against an outwardly extending annular flange 44 on the die collar 40 and with the opposite end thereof being engaged with the enlarged diameter base 38, so as to normally support the die collar 40 in a raised position so as to be effectively form within the upper part of the die collar and the top of the die shaft 36 a cavity for receiving therein the button head 12, as more fully described below.

The flange 44 on the die collar 40 is disposed a short distance below the top of the die collar 40 so as to provide an annular shoulder or stop 46, against which the base 48 of the upper die housing 32 engages during the operation of the die or tool 30. A cavity 50 corresponding in diameter with the diameter of the die collar 40 and of a depth substantially corresponding to the upper part 52 of the die collar 40 extending beyond the shoulder or stop 46 formed by the flange 44 is provided in the base 48 of the upper die housing 32.

The lower end of the plunger 34 of the upper die part 26 has a locking ring cavity 54 formed in it. This locking ring cavity 54 is contoured to substantially correspond with the contour of the head or the top surface of the button head 12, for reasons which will be apparent from the description below. Also, a camming surface 56 is formed about the interior edge of the bore in the die collar 40 and this camming surface 56 functions to guide the marginal edge of the fabric 16 about the locking ring 14, during assembly, as more fully described below. A central bore 58 also is provided in the die shaft 36 for receiving therein the securement means formed on the button head 12, when the latter is disposed atop the die shaft 36. Initially, the plunger 34 is drawn upwardly in the upper die housing 32 to a position such that the marginal edge of the fabric 16 and the locking ring 14, when disposed within the locking ring cavity 54, is free of engagement or contact with the lower die part 28 when the die parts 26 and 28 are initially positioned in contacting engagement. Also, it may be noted that the spring 42 supports the die collar 40 in a raised position about the die shaft 36 so as to effectively form therein a cavity for receiving the button head 12, with the button head 12 being positioned such that it does not extend or project out of the cavity, above the top edge of the die collar 40.

To assemble a fabric-covered button 10, the fabric 16 is first draped about the locking ring 14, and both are disposed within the locking ring cavity 54 in the plunger 34 of the upper die part 26, as generally illustrated in FIG. 6. This can be accomplished in any suitable fashion, as for example, by the use of the fingers or, alternatively, by providing a small wooden shaft which will initially receive the locking ring 14 about its upper end with the fabric 16 draped over the end of the wooden shaft, so that the locking ring 14 and the fabric 16 can be inserted within the locking ring cavity 54. A button head 12 is disposed within the cavity formed by the die shaft 36 and the die collar 40 again as illustrated in FIG. 6.

When the component parts of the button, i.e., the locking ring 14 and the button head 12, together with the fabric 16, are disposed within the die or tool 30, as described, the upper die part 26 is seated atop the lower die part 28, as illustrated in FIG. 7. Next, the plunger 34 is forcibly urged downwardly with respect to the upper die housing 32 and, in the process of doing so, the marginal edge of the fabric 16 engages with the camming surface 56.

As the downward motion of the plunger 34 is continued, the camming surface 56 effectively rolls the marginal edge of the fabric 16 about and into the locking ring 14, as generally illustrated in FIG. 7. The upper surface of the head of the button head 12 may, to some degree, assist or function in conjunction with the camming surface 56 to roll the marginal edge of the fabric 16 about and into the locking ring 14, as described above.

The downward motion of the plunger 34 within the upper die housing 32 is continued, until the set screw 62 engages the upper limit of the guide slot 60, at which time the upper die housing 32 is caused to forcibly exert a downward force on the die collar 40, against the opposing force exerted upon the die collar 40 by the spring 42. As the downward motion is continued, the die collar 40 is forcibly urged downwardly about the die shaft 36, until such time as the locking ring 14 is forced into locking engagement with the locking groove 18 in the button head 12, as illustrated in FIG. 8. Thereafter, the upper die part 26 is removed, and the completed fabric-covered button 10 is removed from the lower die part 28.

Figure 5:
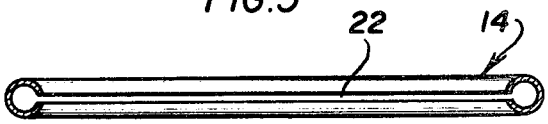
FIG. 5 is a sectional view of an alternative construction of the locking ring.

The locking ring 14 also may be of a shrinkable plastic material, in which case, die or tool 30 is adapted to heat the locking ring once it is disposed in, or in proximity to, the locking groove 18. Otherwise, the construction of the button 10 as well as its manner of assembly is generally the same as described above. The only difference is that the locking ring 14 is heated to cause it to shrink to lockingly secure the fabric 16 in the locking groove. The locking ring 14 also may be of a split-ring construction, i.e., a hollow ring having a slit or groove 22 extending about its interior periphery, as illustrated in FIG. 5. In such cases, the locking ring 14 preferably is of a metallic material, however, it may be of plastic or other similar material which will function to secure the fabric to the button head 12. More particularly, a split-ring locking ring 14 is assembled with the button head 12, in generally the same fashion as described above. The die or tool 30, however, is further adapted to compress or pinch the locking ring 14, to not only tighten it within the locking groove, as in the case of shrinking it, but to effectively pinch the fabric within the groove 22. The latter results from the fact that the fabric tends to find its way into the groove 22 during assembly, and when the locking ring 14 is compressed or pinched, the fabric is effectively locked therein.

It will thus be seen that the objects set forth above, among those made apparent from the preceding description, are efficiently attained and certain changes may be made in carrying out the above method and in the construction set forth. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A fabric covered button comprising: a locking ring; and a button head having a locking groove for receiving therein said locking ring; said fabric covering said button head and said locking ring said the marginal edge thereof being captivated and retained in and between said locking groove and said locking ring, to thereby secure the fabric to the button.

2. The fabric covered button of claim 1, wherein the marginal edge of said fabric extends around the outer periphery of said locking ring and into and through the interior thereof.

3. The fabric covered button of claim 1, wherein said locking ring presses the marginal edge of said fabric into said locking groove.

4. The fabric covered button of claim 1, wherein said locking ring has an elastic memory, whereby the locking ring can be stretched over the button head and will then contract and effectively squeeze the fabric into the locking groove.

5. The fabric covered button of claim 1, wherein said button head is textured.

6. The fabric covered button of claim 1, wherein said button head comprises means whereby it can be slightly compressed during assembly of the button.

7. The fabric covered button of claim 1, further comprising an adhesive on said button head.

8. The fabric covered button of claim 1, further comprising securement means affixed to said button head for securing said button to an article.

9. The fabric covered button of claim 8, wherein said button head is molded of plastic and said securement means is integrally molded with said button head.

10. The fabric covered button of claim 1, wherein said locking ring is of a heat shrinkable material, said locking ring being heated to shrink it to squeeze the fabric into said locking groove and to secure said locking ring to said button head.

11. The fabric covered button of claim 1, wherein said locking groove has an interior diameter d, and the interior diameter of said locking ring is within a range of 0.317 to 0.357 inches greater than the diameter d.

12. The fabric covered button of claim 1, comprising at least two layers of fabric.

13. The fabric covered button of claim 1, wherein the marginal edge of said fabric is sandwiched between said fabric and said button head.

14. Button components, as claimed in claim 1, wherein said button head has securement means affixed to it for securing the fabric covered button to an article.

15. Button components, as claimed in claim 14, wherein said locking ring presses the marginal edge of said fabric into said locking groove.

16. Button components, as claimed in claim 14, wherein said locking ring has an elastic memory, whereby the locking ring can be stretched over the button head and will then contract and effectively squeeze the fabric into the locking groove.

17. Button components, as claimed in claim 14, wherein said button head is textured.

18. Button components, as claimed in claim 14, wherein said button head comprises means whereby it can be slightly compressed during assembly of the button.

19. Button components, as claimed in claim 14, wherein said locking ring is of a heat shrinkable material, said locking ring being heated to shrink it to squeeze the fabric into said locking groove and to secure said locking ring to said button head.

20. Button components, as claimed in claim 14, wherein said locking groove has an interior diameter d, and the interior diameter of said locking ring is within a range of 0.317 to 0.357 inches greater than the diameter d.

21. The fabric covered button of claim 1, wherein said locking ring is of a split-ring construction having a hollow interior and a groove extending about its interior periphery, whereby the fabric is squeezed into the locking groove and the fabric is pinched in the groove when the locking ring is compressed.

22. Button components for use with a piece of fabric for forming a fabric covered button comprising a locking ring and a button head having a locking groove about its periphery for receiving therein said locking ring to secure said piece of fabric to said button head, said piece of fabric being draped over said button head and around said locking ring with the marginal edge thereof secured within said locking groove between said locking ring and said locking groove.

23. Button components, as claimed in claim 22, wherein said locking ring is of a split-ring construction having a hollow interior and a groove extending about its interior periphery, whereby the fabric is squeezed into the locking groove and the fabric is pinched in the groove when the locking ring is compressed.

24. A method of forming a fabric covered button comprising the steps of covering a button head having a locking groove about its periphery with a piece of fabric; and securing said piece of fabric to said button head with a locking ring which is received within said locking groove by extending said piece of fabric over said locking ring and extending the marginal edge thereof into said locking ring, so that the marginal edge of the piece of fabric is secured within the locking groove between the latter and the locking ring.

* * * * *